US010089928B2

(12) United States Patent
Yoo et al.

(10) Patent No.: US 10,089,928 B2
(45) Date of Patent: Oct. 2, 2018

(54) ORGANIC LIGHT EMITTING DISPLAY AND SENSING METHOD THEREFOR

(71) Applicant: LG Display Co., Ltd., Seoul (KR)

(72) Inventors: Jaeik Yoo, Seoul (KR); Myunggi Lim, Ansan-si (KR); Osung Do, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/655,581

(22) Filed: Jul. 20, 2017

(65) Prior Publication Data

US 2018/0033366 A1 Feb. 1, 2018

(30) Foreign Application Priority Data

Jul. 29, 2016 (KR) ..... 10-2016-0097483

(51) Int. Cl.

| | |
|---|---|
| ***G09G 3/30*** | (2006.01) |
| ***G09G 3/3233*** | (2016.01) |
| ***G09G 3/20*** | (2006.01) |
| ***G09G 3/3275*** | (2016.01) |

(52) U.S. Cl.

CPC ..... *G09G 3/3233* (2013.01); *G09G 3/2003* (2013.01); *G09G 3/3275* (2013.01); *G09G 2310/027* (2013.01); *G09G 2310/0297* (2013.01); *G09G 2320/029* (2013.01); *G09G 2320/0219* (2013.01)

(58) Field of Classification Search

CPC ..... G09G 3/30–3/3291

See application file for complete search history.

(56) References Cited

U.S. PATENT DOCUMENTS

| | | | | |
|---|---|---|---|---|
| 2009/0160742 | A1* | 6/2009 | Mizukoshi | G09G 3/3233 345/77 |
| 2012/0019569 | A1* | 1/2012 | Byun | G09G 3/3233 345/690 |
| 2012/0032940 | A1* | 2/2012 | Mizukoshi | G09G 3/006 345/212 |

FOREIGN PATENT DOCUMENTS

| | | |
|---|---|---|
| KR | 10-2013-0134256 | 5/2015 |
| KR | 10-2013-0149395 | 6/2015 |

* cited by examiner

*Primary Examiner* — Sanghyuk Park

(74) *Attorney, Agent, or Firm* — Fenwick & West LLP

(57) ABSTRACT

The sensing method for an organic light-emitting display comprises: defining a pixel group comprising a reference pixel and two or more valid pixels, among a plurality of pixels arranged on a horizontal line; obtaining a black level current sensing value by applying a black level data voltage to the reference pixel; obtaining a current sensing value for a given gray level by applying a data voltage for the given gray level higher than the black level to each of the valid pixels; and obtaining a pixel current sensing value by subtracting the black level current sensing value from the current sensing value for the given gray level to eliminate common noise.

12 Claims, 6 Drawing Sheets

ORGANIC LIGHT EMITTING DISPLAY AND SENSING METHOD THEREFOR

CROSS-REFERENCE TO RELATED APPLICATIONS

This application claims the benefit of Republic of Korea Patent Application No. 10-2016-0097483 filed on Jul. 29, 2016, which is incorporated herein by reference in its entirety.

BACKGROUND

Field of Technology

The present disclosure relates to an organic light-emitting display and a sensing method therefor, and more particularly, to an organic light-emitting display which is capable of sensing electrical characteristics of a driving element.

Discussion of the Related Art

An active matrix-type organic light emitting display comprises self-luminous organic light-emitting diodes (hereinafter, referred to as "OLED"), and has the advantages of fast response time, high luminous efficiency, high luminance, and wide viewing angle.

An OLED, which is a self-luminous element, comprises an anode, a cathode, and organic compound layers formed between the anode and cathode. The organic compound layers comprise a hole injection layer HIL, a hole transport layer HTL, an emission layer EML, and an electron transport layer ETL, and an electron injection layer EIL. When an operating voltage is applied to the anode and the cathode, a hole passing through the hole transport layer HTL and an electron passing through the electron transport layer ETL move to the emission layer EML, forming an exciton. As a result, the emission layer EML generates visible light.

In an organic light-emitting display, pixels each comprising an OLED are arranged in a matrix, and the luminance of the pixels is adjusted based on the grayscale of video data. Each individual pixel comprises a driving element, i.e., driving transistor (thin-film transistor), that controls the drive current flowing through the OLED in response to a voltage Vgs applied between its gate electrode and source electrode. Electrical characteristics of the driving transistor, such as threshold voltage, mobility, etc., may deteriorate over time, causing variations from pixel to pixel. The variations in the electrical characteristics of the driving transistor between the pixels make difference in the luminance of the same video data between the pixels. This makes it difficult to produce a desired image.

There are known methods to compensate for variations in electrical characteristics of a driving transistor: internal compensation and external compensation. In the internal compensation method, variations in threshold voltage between driving transistors are automatically compensated for within a pixel circuit. For internal compensation, the driving current flowing through the OLED needs to be determined regardless of the threshold voltage of the driving transistor, which makes the configuration of the pixel circuit very complicated. Moreover, the internal compensation method is not appropriate to compensate for variations in mobility between the driving transistors.

In the external compensation method, variations in electrical characteristics are compensated for by measuring sensing voltages corresponding to the electrical characteristics (threshold voltage and mobility) of the driving transistors and modulating video data by an external circuit based on these sensing voltages. In recent years, research on the external compensation method is actively underway.

In the conventional external compensation method, a data drive circuit receives a sensing voltage from each pixel through a sensing line, converts the sensing voltage into a digital sensing value, and then transmits it to a timing controller. The timing controller modulates digital video data based on the digital sensing value and compensates for variations in electrical characteristics of a driving transistor.

As the driving transistor is a current element, its electrical characteristics are represented by the amount of current Ids flowing between a drain and source in response to a given gate-source voltage Vgs. By the way, the data drive circuit of the conventional external compensation method senses a voltage corresponding to the current Ids, rather than sensing the current Ids flowing through the driving transistor, in order to sense the electrical characteristics of the driving transistor.

For instance, in the external compensation method disclosed in Republic of Korea Patent Application NO. 10-2013-0134256 and Republic of Korea Patent Application No. 10-2013-0149395 filed by the present applicant, the driving transistor is operated in a source-follower manner, and then a voltage (the driving transistor's source voltage) stored in a line capacitor (parasitic capacitor) on a sensing line is sensed by the data drive circuit. In this external compensation method, the source voltage is sensed when the source electrode potential of the driving transistor DT operating in the source-follower manner reaches a saturation state (i.e., the current Ids of the driving transistor DT becomes zero), in order to compensate for variations in the threshold voltage of the driving transistor. Also, in this external compensation method, a linear voltage is sensed before the source electrode potential of the driving transistor DT operating in the source-follower manner reaches a saturation state, in order to compensate for variations in the mobility of the driving transistor.

The conventional external compensation method has the following problems.

First, the source voltage is sensed after the current flowing through the driving transistor is changed into a source voltage and stored by using a parasitic capacitor on a sensing line. In this case, the parasitic capacitance of the sensing line is rather large, and moreover the amount of parasitic capacitance may change with the display load of the display panel. Because parasitic capacitance is not kept at a constant level but changes due to a variety of environmental factors, it cannot be calibrated. If the amount of parasitic capacitance where current is stored varies between sensing lines, it is difficult to obtain an accurate sensing value.

Second, it takes quite a long time to obtain a sensing value—including the time taken until the source voltage of the driving transistor is saturated—because the conventional external compensation method employs voltage sensing. Especially, when the parasitic capacitance of the sensing line is large, it takes much time to draw enough current to meet a voltage level at which sensing is possible.

SUMMARY

The present disclosure provides a sensing method for an organic light-emitting display, comprising: defining a pixel group comprising a reference pixel and two or more valid pixels, among a plurality of pixels arranged on a horizontal line; obtaining a black level current sensing value by applying a black level data voltage to the reference pixel; obtaining a current sensing value for a given gray level by applying a data voltage for the given gray level higher than the black level to each of the valid pixels; and obtaining a pixel current sensing value by subtracting the black level current sensing value from the current sensing value for the given gray level to eliminate common noise.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

1. Current Sensing Method

A current sensing method on which the present disclosure is based will be described below.

Figure 1:
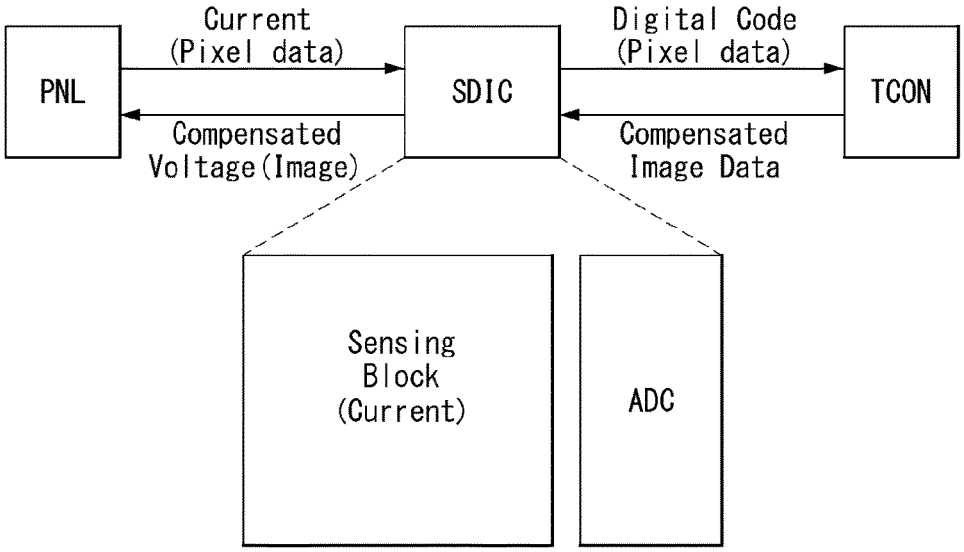
FIG. 1 is a view showing a schematic configuration of an organic light-emitting display which implements external compensation based on a current sensing method.
Figure 2:
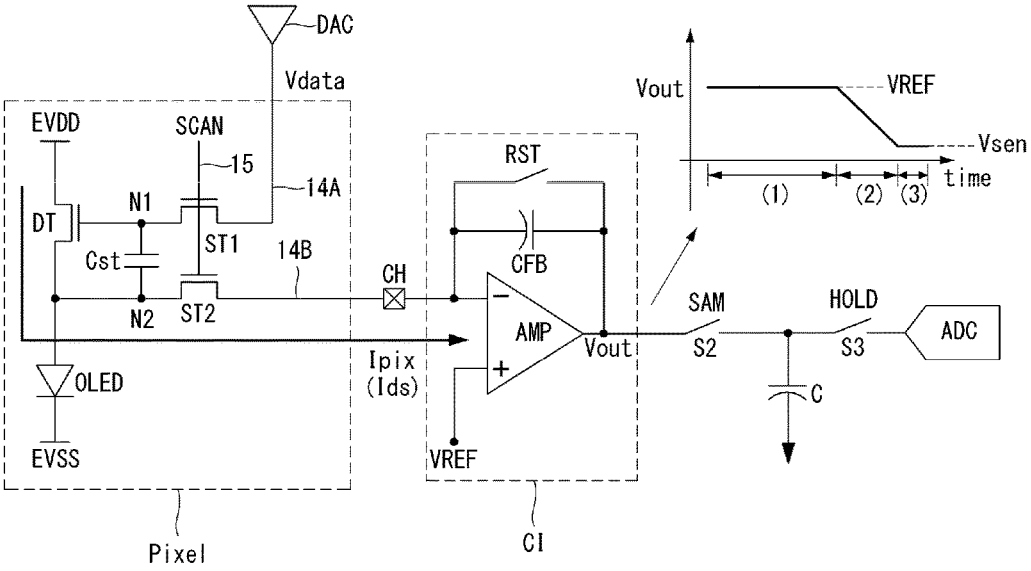
FIG. 2 is a view showing a connection structure between one pixel and a current integrator which is applied to external compensation using the current sensing method.

FIG. 1 shows a schematic configuration of an organic light-emitting display which implements external compensation based on a current sensing method. FIG. 2 shows a connection structure between one pixel and a current integrator which is applied to external compensation using the current sensing method.

Referring to FIG. 1, in the present disclosure, a sensing block and an ADC (analog-to-digital converter), which are required for current sensing, are included in a data drive IC SDIC, and current data is sensed from the pixels of a display panel. The sensing block comprises a plurality of current integrators, and performs an integration of the current data input from the display panel PNL. The pixels of the display panel are connected to sensing lines, and the current integrators are connected to the sensing lines via sensing channels. An integrated value (represented by a voltage) obtained from each integrator is sampled and held and input into the ADC. The ADC converts an analog integrated value into a digital sensing value, and then transmits it to a timing controller TCON. The timing controller TCON derives compensation data for compensating for threshold voltage variation and mobility variation based on the digital sensing value, modulates image data for image display using the compensation data and then transmits it to the data drive IC SDIC. The modulated image data is converted into a data voltage for image display by the data drive IC SDIC and then applied to the display panel PNL.

FIG. 2 depicts a connection structure between one pixel and a current integrator which is applied to external compensation using the current sensing method. Referring to FIG. 2, a pixel P may comprise an organic light-emitting diode OLED, a driving transistor (thin-film transistor) DT, a storage capacitor Cst, a first switching transistor ST1, and a second switching transistor ST2.

The organic light-emitting diode OLED comprises an anode connected to a second node N2, a cathode connected to the input terminal of a low-potential driving voltage EVSS, and an organic compound layer located between the anode and the cathode. The driving transistor DT controls the amount of current going into the organic light-emitting diode OLED according to a gate-source voltage Vgs. The driving transistor DT comprises a gate electrode connected to a first node N1, a drain electrode connected to the input terminal of a high-potential driving voltage EVDD, and a source electrode connected to the second node N2. The storage capacitor Cst is connected between the first node N1 and the second node N2. The first switching transistor ST1 applies a data voltage Vdata on a data voltage supply line 14A to the first node N1 in response to a gate pulse SCAN. The first switching transistor ST1 comprises a gate electrode connected to a gate line 15, a drain electrode connected to the data voltage supply line 14A, and a source electrode connected to the first node N1. The second switching transistor ST2 switches the flow of current between the second node N2 and a sensing line 14B in response to a gate pulse SCAN. The second switching transistor ST2 comprises a gate electrode connected to the gate line 15, a drain electrode connected to the sensing line 14B, and a source electrode connected to the second node N2.

As shown in FIG. 2, a current integrator CI comprises an amplifier AMP comprising an inverting input terminal (−) connected to the sensing line 14B via a sensing channel CH and receiving a pixel current Ipix, i.e., the source-drain current Ids of the driving transistor DT, from the sensing line 14B, a non-inverting input terminal (+) for receiving a reference voltage VREF, and an output terminal, an integration capacitor CFB connected between the inverting input terminal (−) and output terminal of the amplifier AMP, and a reset switch RST connected to both ends of the integration capacitor CFB.

The current integrator CI is connected to the ADC through a sample & hold circuit. The sample & hold circuit comprises a sampling switch SAM for sampling the output Vout of the amplifier AMP, a sampling capacitor C storing the output Vout applied through the sampling switch (SAM) S2, and a holding switch (HOLD) S3 for sending the output Vout stored in the sampling capacitor C to the ADC.

A sensing operation for obtaining an integrated value Vsen from the current integrator CI is performed in several periods including a reset period 1, a sensing period 2, and a sampling period 3.

In the reset period 1, the amplifier AMP operates as a unit gain buffer with a gain of 1 by the turn-on of the reset switch RST. In the reset period 1, the input terminals (+,−) and output terminal of the amplifier AMP, the sensing line 14B, and the second node N2 are all reset to the reference voltage VREF.

During the reset period 1, a sensing data voltage Vdata-SEN is applied to the first node N1 through the DAC of the data drive IC SDIC. Accordingly, a source-drain current Ids corresponding to a potential difference {(Vdata-SEN)-VREF} between the first node N1 and the second node N2 flows to the driving transistor DT and becomes stable. However, since the amplifier AMP continues to act as the unit gain buffer during the reset period 1, the potential of the output terminal is maintained at the reference voltage VREF.

In the sensing period 2, the amplifier AMP operates as the current integrator CI by the turn-off of the reset switch RST to perform an integration of the source-drain current Ids flowing through the driving transistor DT by using the integration capacitor CFB. In the sensing period 2, the potential difference between both ends of the integration capacitor CFB increases due to the current Ids entering the inverting input terminal (−) of the amplifier AMP as the sensing time passes, i.e., the accumulated value of current Ids increases. However, the inverting input terminal (−) and the non-inverting input terminal (+) are shorted through a virtual ground due to the characteristics of the amplifier AMP, and the potential difference between the inverting input terminal (−) and the non-inverting input terminal (+) is zero. Therefore, the potential of the inverting input terminal (−) is maintained at the reference voltage VREF in the sensing period 2, regardless of whether the potential difference across the integration capacitor CFB increases or not. Instead, the output terminal potential of the amplifier AMP decreases in response to the potential difference between both ends of the integration capacitor CFB. Based on this principle, in the sensing period 2, the current Ids entering through the sensing line 14B is produced as an integrated value Vsen, which is a voltage value, through the integration capacitor CFB. The falling slope of an output Vout of the current integrator CI increases as the amount of current Ids entering through the sensing line 14B becomes larger. Therefore, the larger the amount of current Ids, the smaller the integrated value Vsen. In the sensing period 2, the integrated value Vsen passes through the sampling switch SAM and is stored in the sampling capacitor C.

In the sampling period 3, when the holding switch HOLD is turned on, the integrated value Vsen stored in the sampling capacitor C passes through the holding switch HOLD and is input into the ADC. The integrated value Vsen is converted into a digital sensing value by the ADC and then transmitted to the timing controller. The timing controller applies the digital sensing value to a compensation algorithm to derive a threshold voltage variation Δ Vth and mobility variation Δ K in the driving transistor and compensation data for compensating for these variations. The compensation algorithm may be implemented as a look-up table or a calculational logic.

The capacitance of the integration capacitor CFB included in the current integrator CI is only one-several hundredths of the parasitic capacitance existing across the sensing line. Thus, the current sensing method of this invention can drastically reduce the time taken to draw enough current Ids to meet the integrated value Vsen with which sensing is possible, as compared to a conventional voltage sensing method. Moreover, in the conventional voltage sensing method, it takes quite a long time to sense a threshold voltage because the source voltage of the driving transistor is sampled as a sensing voltage after it is saturated; whereas, in the current sensing method of this invention, it takes much less time to sense a threshold voltage and mobility because an integration of the source-drain current of the driving transistor and sampling of the integration value can be performed within a short time by means of current sensing.

Also, the integration capacitor CFB included in the current integrator CI of this invention is able to obtain an accurate sensing value because its stored values do not change with display load but can be easily calibrated, unlike the parasitic capacitor of the sensing line.

As such, the present disclosure can greatly reduce sensing time by implementing low-current, high-speed sensing by a current sensing method using a current integrator.

2. Drawbacks of Current Sensing Method

Figure 3:
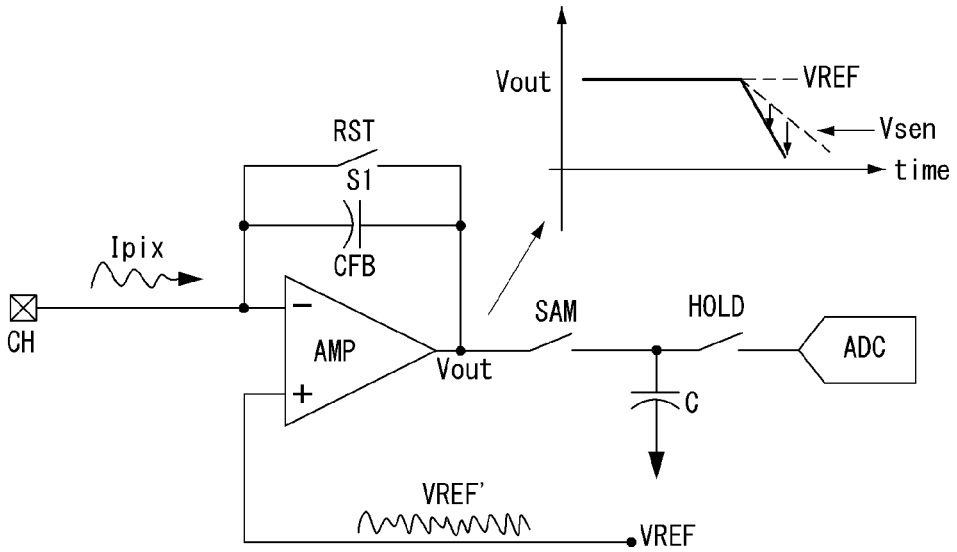
FIG. 3 is a view showing drawbacks of the current sensing method which is susceptible to external noise.

FIG. 3 shows drawbacks of the current sensing method which is susceptible to external noise.

As stated above, the current sensing method using a current integrator is advantageous when reducing sensing time, compared to the conventional voltage sensing methods, but has the drawback of being susceptible to noise because the pixel current Ipix (source-drain current Ids of the driving transistor) to be sensed is usually very small. Noise may enter the current integrator due to variations in the reference voltage VREF applied to the non-inverting input terminal (+) of the current integrator and different sources of noise between the sensing lines connected to the inverting input terminal (−) of the current integrator. Such noise is amplified within the current integrator and applied to the integrated value Vsen, thus causing distortion in the sensing result. Moreover, it is difficult to accurately sense the actual pixel current Ipix since, using the current sensing method, leakage current components in the corresponding channel cannot be applied to the integrated value from the current integrator.

Such a decrease in sensing performance leads to lower compensation performance because electrical characteristics of the driving transistor cannot be compensated as much as desired.

An improved current sensing method capable of offering higher sensing performance will be discussed below.

Figure 4:
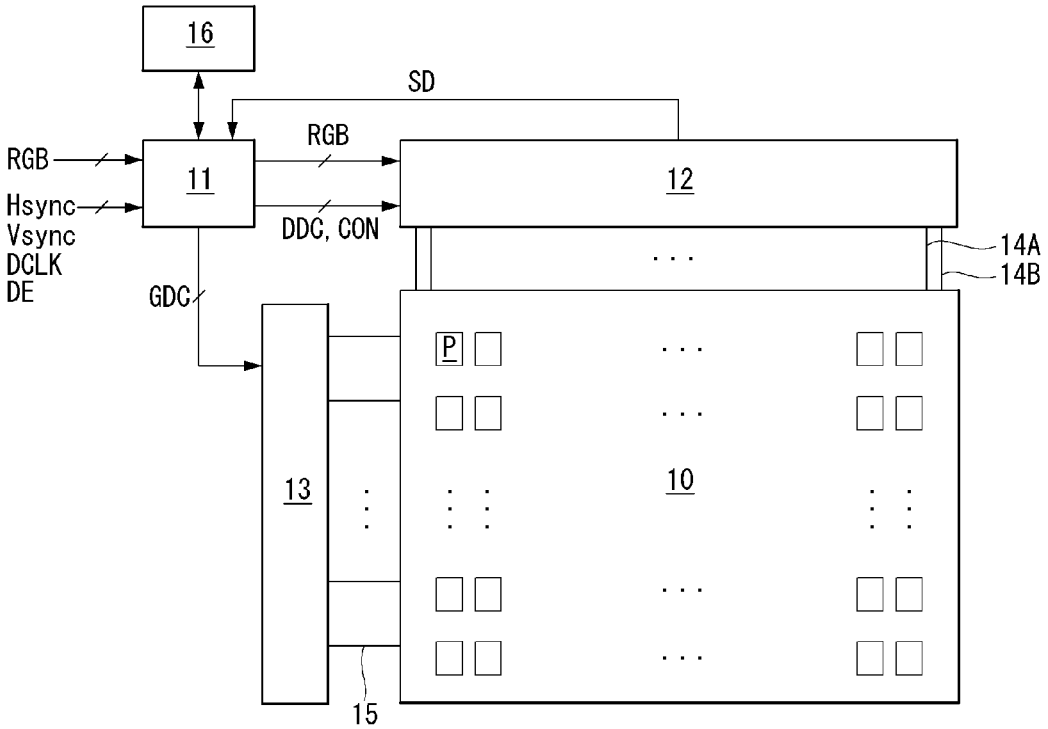
FIG. 4 is a view showing an organic light-emitting display according to an exemplary embodiment of the present disclosure to which an improved current sensing method is applied.
Figure 5:
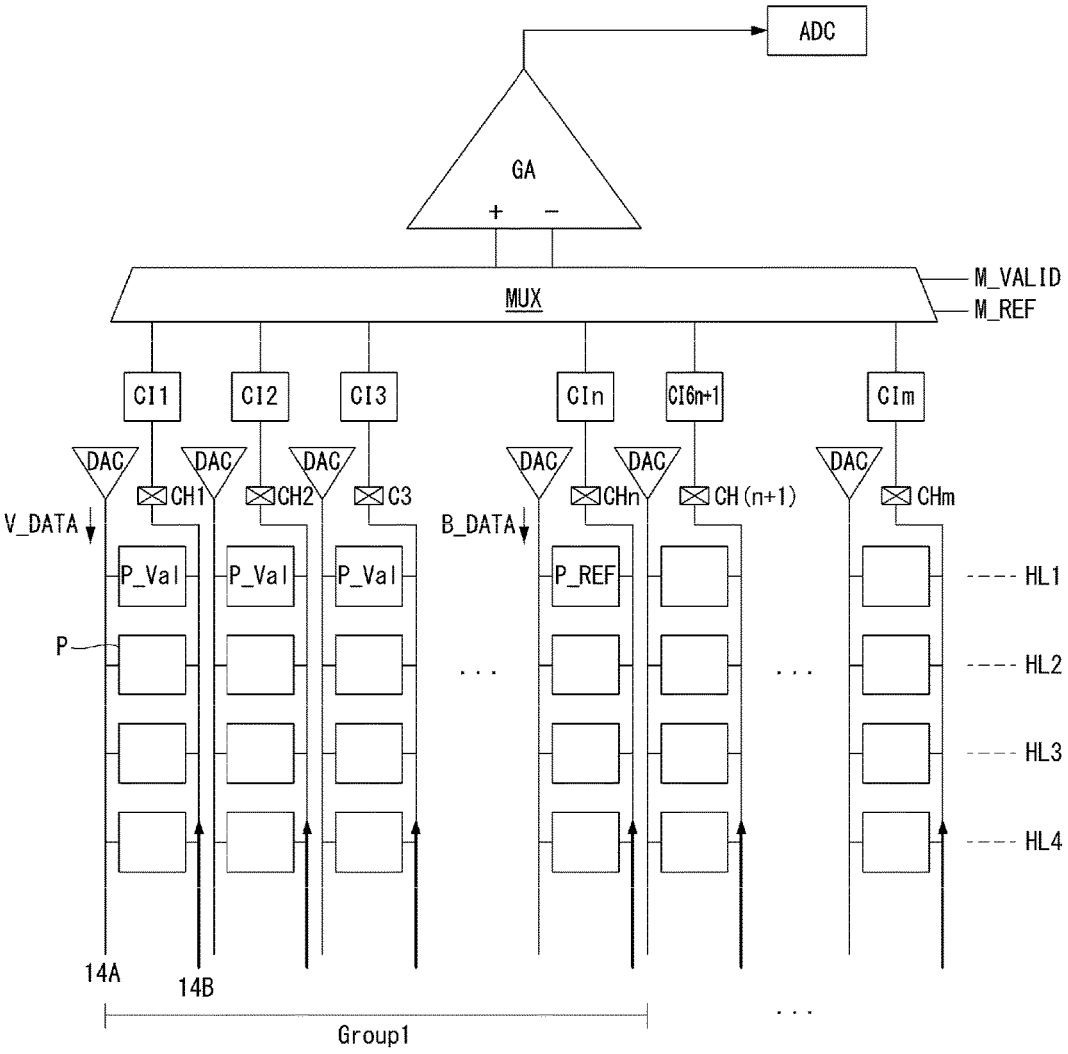
FIG. 5 is a view showing a pixel array formed on the display panel of FIG. 4 and a configuration of a data drive IC for implement the improved current sensing method according to an exemplary embodiment.
Figure 6:
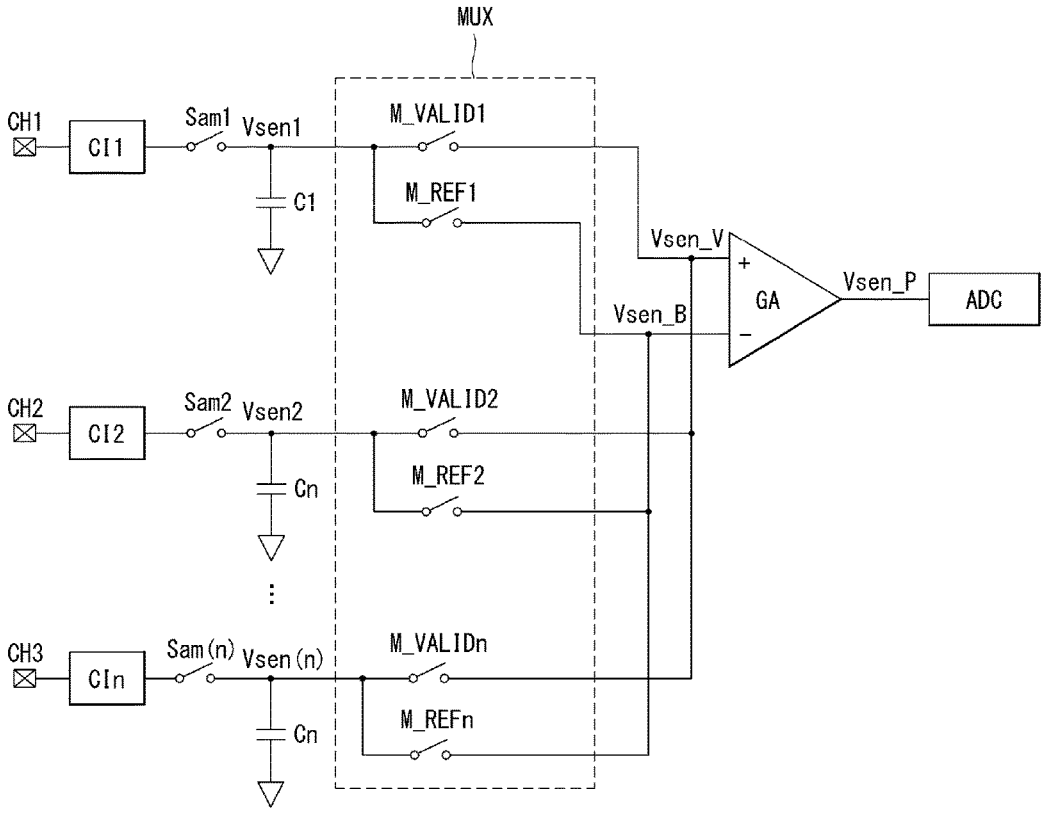
FIG. 6 is a view showing a switch structure of a multiplexer shown in FIG. 5 according to an exemplary embodiment.

3. Improved Current Sensing Method According To The Present Invention and Embodiments Using the Same FIG. 4 shows an organic light-emitting display according to an exemplary embodiment of the present disclosure to which an improved current sensing method is applied. FIG. 5 shows a pixel array formed on the display panel of FIG. 4 and a configuration of a data drive IC for implement the improved current sensing method according to an exemplary embodiment. FIG. 6 shows a switch structure of a multiplexer shown in FIG. 5 according to an exemplary embodiment. The integrators shown in FIGS. 5 and 6 may have the same configuration as the integrators shown in FIG. 2.

Referring to FIGS. 2, 4, and 5, the organic light-emitting display according to the exemplary embodiment of the present disclosure comprises a display panel 10, a timing controller 11, a data drive circuit 12, a gate drive circuit 13, and a memory 16.

A plurality of data lines 14A and sensing lines 14B and a plurality of gate lines 15 cross over each other on the display panel 10, and pixels P are arranged in a matrix formed at their crossings.

Each pixel P is connected to any one of the data lines 14A, any one of the sensing lines 14B, and any one of the gate lines 15. Each pixel P is electrically connected to a data voltage supply line 14A to receive a data voltage form the data voltage supply line 14A and output a sensing signal through a sensing line 14B, in response to a gate pulse input through a gate line 15.

Each pixel P receives a high-potential driving voltage EVDD and a low-potential driving voltage EVSS from a power generator (not shown). For external compensation, a pixel P may comprise an organic light-emitting diode OLED, a driving transistor, first and second switching transistors, and a storage capacitor. The transistors constituting the pixel P may be implemented as p-type or n-type. Also, a semiconductor layer of the transistors constituting the pixel P may comprise amorphous silicon, polysilicon, or oxide.

Each pixel P may operate differently in a normal driving operation for displaying an image and in a sensing operation for obtaining a sensing value. Sensing may be performed for a predetermined period of time before normal driving or for vertical blank periods during normal driving.

Normal driving is an operation the data drive circuit 12 and the gate drive circuit 13 perform under the control of the timing controller 11. Sensing is an operation the data drive circuit 12 and the gate drive circuit 13 perform under the control of the timing controller 11. An operation of deriving compensation data for variation compensation based on a sensing result and an operation of modulating digital video data using compensation data are performed by the timing controller 11.

In the sensing operation, m pixels P arranged on each horizontal line HL are driven in pixel groups each comprising a plurality of pixels P.

In a horizontal line HL, n pixels P (n is a natural number less than m) included in each pixel group comprises a reference pixel P_REF and (n-1) valid pixels P_Val. While this specification illustrates one reference pixel P_REF, two or more reference pixels P_PREF may be provided. While FIG. 5 illustrates an embodiment in which the reference pixel P_REF of the first horizontal line HL1 belongs to an nth column, the reference pixel P_REF on each horizontal line HL may belong to other columns.

In the sensing operation, the reference pixel P_REF receives a black level data voltage B_data, and the valid pixels P_Val each receive a data voltage V_DATA for a given gray level.

The data drive circuit 12 comprises at least one data drive IC (integrated circuit). The data drive IC comprises a plurality of digital-to-analog converters (hereinafter, DACs) individually connected to data lines 14A, a plurality of integrators CI connected to sensing lines 14B through sensing channels CH, a multiplexer MUX, a subtractor GA, and an ADC.

In a normal driving operation, the DAC of the data drive IC converts digital video data RGB into a data voltage for image display and supplies it to the data lines 14A, in response to a data timing control signal DDC applied from the timing controller 11. On the other hand, in a sensing operation, the DAC of the data drive IC generates a sensing data voltage and supplies it to the data lines 14A, in response to a data timing control signal DDC applied from the timing controller 11. The sensing data voltage comprises a data voltage V_DATA for a given gray level that generates a pixel current (the source-drain current Ids of the driving transistor) above 0 and a black level data voltage B_DATA that suppresses the generation of the pixel current. In the sensing operation, the data drive IC supplies through the data lines 14A the black level data voltage B_DATA to the reference pixel P_PREF and a data voltage V_DATA for a given gray level to each of the valid pixels P_Val.

The current integrators CI1 to CIn store an integrated value of current sensing values for driving the pixels in response to a sensing data voltage, in the sampling capacitors C1 to Cn. As illustrated in FIG. 2, the current integrators CI1 to CIn each comprise an amplifier amp, an integrating capacitor CFB, and a reset switch RST.

The first integrator CI1 obtains a first current sensing value Vsen1 for a first pixel P1 driven by a data voltage V_DATA for a given gray level, and the second integrator CI2 obtains a second current sensing value Vsen2 for a second pixel P2 driven by a data voltage V_DATA for a given gray level. Likewise, the ith integrator (i is a natural number of (n-1) or less) obtains an ith current sensing value for an ith pixel driven by a data voltage V_DATA for a given gray level. When a current sensing value obtained based on a data voltage V_DATA for a given gray level is defined as a current sensing value Vsen_V for the given gray level, the current sensing value Vsen_V for the given gray level is a pixel current sensing value Vsen_P ideal for the given gray level, with common noise components mixed in.

The nth integrator CIn obtains an nth current sensing value for an nth pixel Pn driven by the black level data voltage B_DATA. When a current sensing value obtained based on the black level data voltage B_DATA is defined as a black level current sensing value Vsen_B, the black level current sensing value Vsen_B is a zero current sensing value Vsen_B ideal for black level 0G, with common noise components mixed in.

An integrated value obtained by each integrator CI is stored in the sampling capacitor C by operation of the sampling switch SAM.

The multiplexer MUX comprises valid channel switches M_VALID1 to M_VALIDn that switch the path between each sampling capacitor C and a non-inverting input terminal (+) of the subtractor GA and reference channel switches M_REF1 to M_REFn that switch the path between each sampling capacitor C and an inverting input terminal (−) of the subtractor GA.

During a noise cancellation period, the valid channel switches M_VALID1 to M_VALIDn connected to the valid pixels P_Val are sequentially turned on. Also, the reference channel switch M_REFn connected to the reference pixel P_REF is turned on in sync with the turn-on of the valid channel switches M_VALID1 to M_VALIDn. Consequently, the multiplexer MUX applies the black level current sensing value to the inverting input terminal (−) of the subtractor GA and any one of the current sensing values for given gray levels to the non-inverting input terminal (+) of the subtractor GA, within the pixel group during the noise cancellation period.

The subtractor GA receives a current sensing value for a given gray level by the non-inverting input terminal (+) and receives the black level current sensing value by the inverting input terminal (−). The subtractor GA may be implemented as a differential amplifier that subtracts a voltage value at the inverting input terminal (−) from a voltage value at the non-inverting input terminal (+) and amplifies the difference. Since the subtractor GA subtracts the black level current sensing value Vsen_B from a current sensing value Vsen_V for a given gray level, the common noise components included in the current sensing value Vsen_V for the given gray level are eliminated, thereby obtaining a pixel current sensing value Vsen_P.

In the normal driving operation, the gate drive circuit 13 generates an gate pulse for image display based on a gate control signal GDC and then sequentially supplies it to the gate lines 15 in a line sequential manner HL1, HL2, . . . . In the sensing operation, the gate drive circuit 13 generates a gate pulse for sensing based on the gate control signal GDC and then sequentially supplies it to the gate lines 15 in a line sequential manner. The gate pulse for sensing may have a larger ON pulse region than the gate pulse for image display. The ON pulse region of the sensing gate pulse corresponds to one line sensing ON time. Here, one line sensing ON time denotes the scan time taken to simultaneously sense the pixels on one horizontal line HL.

The timing controller 11 generates a data control signal DDC for controlling the operation timing of the data drive circuit 12 and a gate control signal GDC for controlling the operation timing of the gate drive circuit 13, based on timing signals such as a vertical synchronization signal Vsync, a horizontal synchronization signal Hsync, a dot clock signal DCLK, and a data enable signal DE. The timing controller 11 identifies normal driving and sensing based on a given reference signal (driving power enable signal, vertical synchronization signal, data enable signal, etc.), and generates a data control signal DDC and a gate control signal GDC depending on each driving operation.

In the sensing operation, the timing controller 11 may transmit digital data corresponding to a sensing data voltage to the data drive circuit 12. The digital data comprises valid data corresponding to a data voltage for a given gray level and black data corresponding to the black level data voltage. In the sensing operation, the timing controller 11 applies a digital sensing value SD transmitted from the data drive circuit 12 to a pre-stored compensation algorithm to derive a threshold voltage variation Δ Vth and a mobility variation Δ K, and then stores in a memory 16 compensation data for compensating for these variations.

In the normal driving operation, the timing controller 11 modulates digital video data RGB for image display with reference to the compensation data stored in the memory 16 and then transmits it to the data drive circuit 12.

Figure 7:
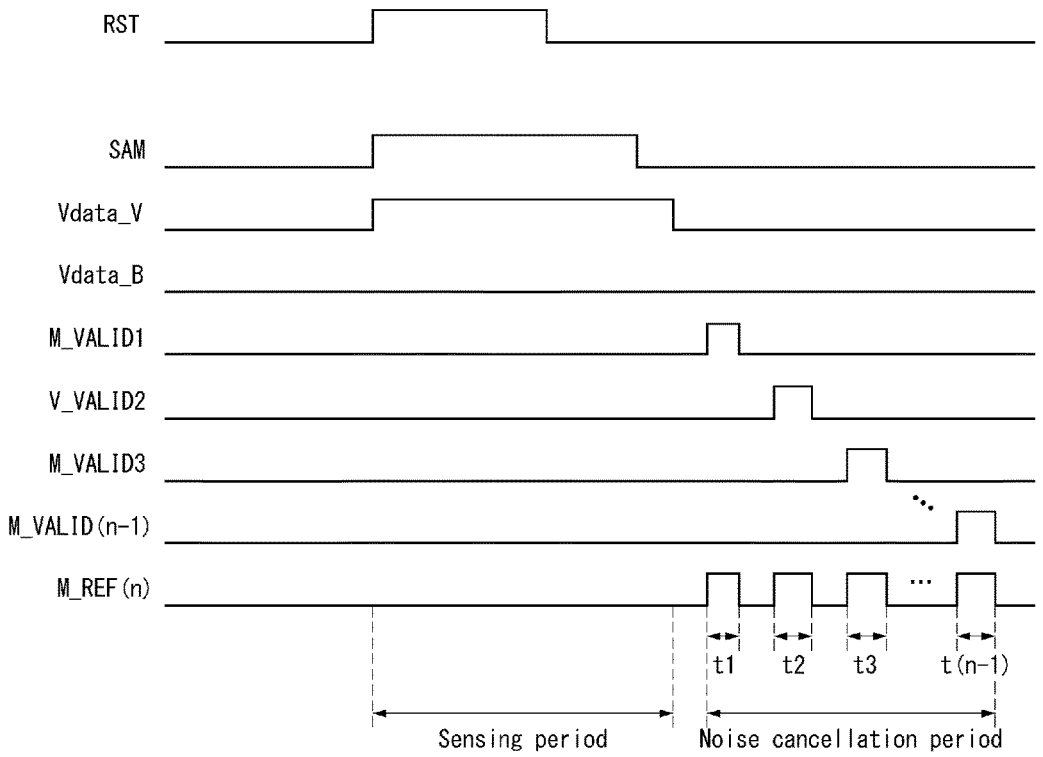
FIG. 7 is a view showing driving signals applied to the data drive IC according to an exemplary embodiment.

FIG. 7 shows driving signals applied to the data driver. For convenience, the driving signals of FIG. 7 are denoted by the same reference characters as the switches in the individual components. In FIG. 7, a high-level voltage of each driving signal represents a turn-on voltage of the corresponding switch, and a low-level voltage of each driving signal represents a turn-off voltage of the corresponding switch. FIG. 7 depicts a sensing mode for a pixel group. Also, FIG. 7 illustrates driving signals for a first channel group on 1 horizontal line HL1 in which first to (n-1)th pixels are assigned as valid pixels.

Referring to FIGS. 2, 5, and 7, the sensing mode comprises a sensing period and a noise cancellation period. The sensing mode is performed based on pixel current information applied from the display panel which causes the display panel to operate.

In the sensing period, pixel currents input from the first to nth sensing lines are sensed.

During the sensing period, the black level data voltage B_DATA is applied to the reference pixel P_REF, and a data voltage V_DATA for a given gray level is applied to each of the valid pixels P_Val. That is, the black level data voltage B_DATA is applied to the nth pixel Pn, and a data voltage V_DATA for a given gray level is applied to each of the first to (n-1)th pixels P1 to P[n-1].

In the sensing period, the reset switches RST of the first to nth current integrators CI1 to CIn are turned on, and the first to nth current integrators CI1 to CIn operate as unit gain buffers. In this case, a pixel current Ipix with noise components mixed in is applied to the first to (n-1)th channels Ch1 to Ch[n-1], and a zero current Izero caused by the noise components is applied to the nth channel CHn.

In the sensing period, when the reset switches RST of the first to nth current integrators CI1 to CIn are turned off, the current integrators operate in an integration mode. By the integration mode, outputs from the first to (n-1)th current integrators are stored in the first to (n-1)th sampling capacitors C1 to C[n-1]. The first to (n-1)th current sensing values Vsen1 to Vsen[n-1] stored in the first to (n-1)th sampling capacitors C1 to C[n-1] each comprise a pixel current sensing value Vsen_P with noise components mixed in.

By the integration mode, the output from the nth current integrator CIn is stored in the nth sampling capacitor Cn. The nth current sensing value Vsen[n] stored in the nth sampling capacitor Cn comprises a zero current sensing value Vsen_O with noise components mixed in.

In the noise cancellation period subsequent to the sensing period, the black level current sensing value Vsen_B is subtracted from a current sensing value Vsen_V for a given gray level. As mentioned previously, a current sensing value Vsen_V for a given gray level comprises an ideal pixel current sensing value Vsen_P and common noise components, and the black level current sensing value Vsen_B comprises an ideal zero current sensing value Vsen_O and the common noise components. Accordingly, when the black level current sensing value Vsen_B is subtracted from the current sensing value Vsen_V for the given gray level, the common noise components are eliminated, thereby obtaining a pixel current sensing value Vsen_P. The noise cancellation period comprises first to (n-1)th periods t1 to t[n-1] for obtaining pixel current sensing values Vsen_P for the valid pixels P_Val by eliminating noise.

During the first period t1, the first valid channel switch M_VALID1 and the nth reference channel switch M_REF1 are turned on. As a consequence, a first current sensing value Vsen1 is applied to the non-inverting input terminal (+) of the subtractor GA, and the nth current sensing value Vsen[n] is applied to the inverting input terminal (−). The subtractor GA outputs a first pixel current sensing value Vsen_P1 by subtracting the nth current sensing value Vsen[n] from the first current sensing value Vsen1. The ADC converts the first pixel current sensing value Vsen_P1 output from the substractor GA into a first digital sensing value. As a result, the first digital sensing value reflects the current value of the first pixel P1 that does not comprise noise effect.

During the second period t2, the second valid channel switch M_VALID2 and the nth reference channel switch M_REF1 are turned on. As a consequence, a second current sensing value Vsen2 is applied to the non-inverting input terminal (+) of the subtractor GA, and the nth current sensing value Vsen[n] is applied to the inverting input terminal (−). The subtractor GA outputs a second pixel current sensing value Vsen_P2 by subtracting the nth current sensing value Vsen[n] from the second current sensing value Vsen2. The ADC converts the second pixel current sensing value Vsen_P2 output from the substractor GA into a second digital sensing value. As a result, the second digital sensing value reflects the current value of the second pixel P2 that does not comprise noise effect.

Likewise, during the ith period (i is a natural number of (n-1) or less), the substractor GA outputs an ith pixel current sensing value Vsen_Pi by eliminating common noise components. Then, the ADC converts the ith pixel current sensing value Vsen_Pi into an ith digital sensing value.

As discussed above, the present disclosure can greatly increase sensing accuracy (sensing performance) and moreover greatly improve the performance of a compensation operation based on sensing results.

Particularly, in the sensing method according to the present disclosure, current sensing values for all pixels in a group, except the reference pixel, are obtained during a sensing period. Accordingly, the sensing operation which takes a relatively long time is performed only once, and common noise is eliminated sequentially for each pixel, thereby considerably reducing the sensing period.

Figure 8:
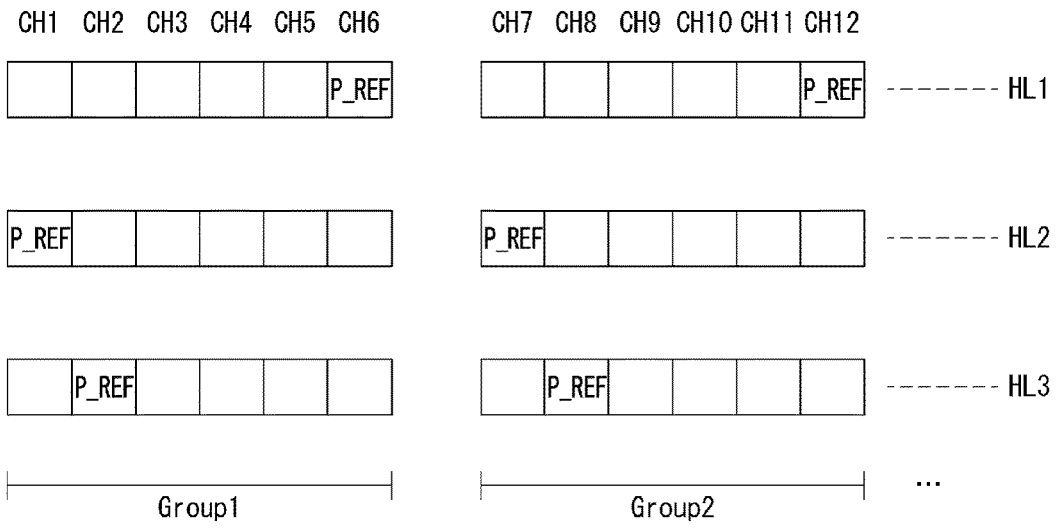
FIG. 8 is a view showing an example of assigning a reference pixel in a pixel group according to an exemplary embodiment.

While the foregoing exemplary embodiments have been described with respect to an example in which the pixel on the nth column is assigned as the reference pixel, the reference pixel P_REF may differ for each horizontal line HL. For example, as shown in FIG. 8, the reference pixel P_REF on the second horizontal line HL2 may be the pixel P in the first column, and the reference pixel P_REF on the third horizontal line HL3 may be the pixel P in the second column.

Moreover, the reference pixel P_REF on each horizontal line HL may differ for each frame. For example, on the first horizontal line HL of FIG. 8, the reference pixel P_REF on the first frame may be the pixel in the sixth column, and the reference pixel P_REF on the next frame may be a pixel in other columns. This way, the amount of deterioration of each pixel P may be smoothed out by varying the position of the reference pixel P_REF.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A sensing method for an organic light-emitting display which comprises a plurality of pixels connected to data lines and sensing lines, each pixel comprising an organic light-emitting diode and a driving transistor driving the organic light-emitting diode, and which obtains a current sensing value of a source-drain current of the driving transistor in response to a data voltage applied to the pixels, the method comprising:

defining a pixel group comprising a reference pixel and two or more valid pixels, among a plurality of pixels arranged on a horizontal line;

obtaining a black level current sensing value by applying a black level data voltage to the reference pixel;

obtaining a current sensing value for a given gray level by applying a data voltage for the given gray level higher than the black level to each of the valid pixels; and obtaining a pixel current sensing value by subtracting the black level current sensing value from the current sensing value for the given gray level to eliminate common noise.

2. The sensing method of claim 1, wherein the pixel group comprises first to (n-1)th valid pixels (n is a natural number) and a reference pixel, and the obtaining of a black level current sensing value and the obtaining of a current sensing value for a given gray level of each of the first to (n-1)th valid pixels are performed within a sensing period and overlap in part of the sensing period.

3. The sensing method of claim 2, wherein the pixel current sensing values for the first to (n-1)th valid pixels are sequentially obtained.

4. An organic light-emitting display comprising:

a display panel on which a plurality of pixels connected to data lines and sensing lines are arranged, each pixel comprising an organic light-emitting diode and a driving transistor driving the organic light-emitting diode, and in which the pixels arranged on a horizontal line are driven in a sensing mode in pixel groups each comprising a reference pixel and first to (n-1)th valid pixels; and a data driver that senses current values of the pixels in the sensing mode, wherein the data driver comprises:

a digital-to-analog converter (DAC) that applies a black level data voltage to the reference pixel and a data voltage for a given gray level to each of the valid pixels, during a sensing period of the sensing mode;

first to (n-1)th current integrators that obtain current sensing values for given gray levels of the first to (n-1)th valid pixels during the sensing period;

an nth current integrator that obtains a black level current sensing value for the reference pixel during the sensing period;

a multiplexer that outputs any one of the current sensing values for given gray levels of the first to (n-1)th valid pixels as a first output value and the black level current sensing value as a second output value, during a noise cancellation period subsequent to the sensing period; and a subtractor that outputs a pixel current sensing value for the valid pixel by subtracting the second output value form the first output value during the noise cancellation period to eliminate common noise components.

5. The organic light-emitting display of claim 4, wherein the black level current sensing value is a current sensing value of a source-drain current of the driving transistor with common noise components mixed in that is obtained when a black level data voltage is applied to the reference pixel.

6. The organic light-emitting display of claim 4, wherein the current sensing value for a given gray level is a current sensing value of the source-drain current of the driving transistor with common noise components mixed in that is obtained when a data voltage for the given gray level higher than the black level is applied to any one of the first to (n-1)th valid pixels.

7. The organic light-emitting display of claim 4, wherein the subtractor is a differential amplifier comprising:

a non-inverting input terminal that receives the first output value; and an inverting input terminal that receives the second output value.

8. The organic light-emitting display of claim 4, wherein the data driver further comprises first to nth sampling capacitors that sample and store current sensing values accumulated by the first to nth current integrators, and the multiplexer comprises:

first to nth valid channel switches that switch the first to nth sampling capacitors and the non-inverting input terminal; and first to nth reference channel switches that switch the first to nth sampling capacitors and the inverting input terminal.

9. The organic light-emitting display of claim 8, wherein the first to (n-1)th valid channel switches are sequentially turned on within the noise cancellation period.

10. The organic light-emitting display of claim 9, wherein, within the noise cancellation period, the nth reference channel switch is turned on each time the first to (n-1)th valid channel switches are turned on.

11. The organic light-emitting display of claim 4, wherein, within a pixel group comprising n pixels, the column in which the reference pixel is positioned differs for each horizontal line or for each frame.

12. The organic light-emitting display of claim 4, wherein the ith current integrator (i is a natural number of n or greater) comprises:

an amplifier comprising an inverting input terminal connected to an ith sensing channel, a non-inverting input terminal receiving a reference voltage, and an amplifier outputting sampled values; and an integration capacitor connected between the inverting input terminal and output terminal of the amplifier; and a first switch connected to two ends of the integration capacitor.

* * * * *